US007185521B2

(12) United States Patent
Lombardo et al.

(10) Patent No.: US 7,185,521 B2
(45) Date of Patent: Mar. 6, 2007

(54) METHOD AND APPARATUS FOR PROCESS CONTROL OF BURNISHING

(75) Inventors: Dale Robert Lombardo, Blue Ash, OH (US); Alberto Luna, Cincinnati, OH (US); Michael J. Brunck, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 19 days.

(21) Appl. No.: 11/128,565

(22) Filed: May 13, 2005

(65) Prior Publication Data

US 2006/0254333 A1 Nov. 16, 2006

(51) Int. Cl.
*B21D 17/04* (2006.01)
*B21B 37/00* (2006.01)

(52) U.S. Cl. ..... 72/75; 72/7.1; 72/7.4; 72/293; 29/90.01

(58) Field of Classification Search ..... 72/53, 72/7.1, 7.3, 11.1, 31.02, 75, 293, 295, 296, 72/7.4, 7.5; 29/90.01
See application file for complete search history.

(56) References Cited

U.S. PATENT DOCUMENTS 2,393,317 A * 1/1946 Edwards, Jr. et al. ..... 72/293
3,638,464 A 2/1972 Winter et al.
3,690,140 A * 9/1972 Shive ..... 72/293
3,695,091 A 10/1972 Smith
3,950,642 A 4/1976 Feld
4,470,292 A 9/1984 DeClark et al.
4,974,434 A * 12/1990 Reccius et al. ..... 72/53
5,731,509 A 3/1998 Thompson
5,771,729 A 6/1998 Bailey et al.
5,877,405 A 3/1999 Champaigne
6,289,713 B1 9/2001 Champaigne
6,568,239 B1 5/2003 Champaigne
6,622,570 B1 * 9/2003 Prevey, III ..... 73/826
6,959,572 B2 * 11/2005 Lawrence et al. ..... 72/31.03

* cited by examiner

*Primary Examiner*—Ed Tolan
(74) *Attorney, Agent, or Firm*—Adams Evans P.A.; Theodore P. Cummings

(57) ABSTRACT

An apparatus for process control of a burnishing process comprising a body having a first end and a second end, at least one process control coupon, and structure for attaching the process control coupon to the body. At least one edge of the process control coupon is clamped along the entire length thereof during burnishing. A method of process control for burnishing of components comprising selecting at least one process control coupon, selecting an apparatus for holding the process control coupon(s), attaching the process control coupon(s) to the apparatus, selecting a region on the surface of the process control coupon(s) for burnishing, burnishing a patch on the selected region using a burnishing process, and, measuring at least one physical parameter at a selected location of the process control coupon(s) after burnishing.

17 Claims, 5 Drawing Sheets

METHOD AND APPARATUS FOR PROCESS CONTROL OF BURNISHING

BACKGROUND OF THE INVENTION

This invention relates generally to the manufacture of components used in complex machines such as aircraft engines, and more specifically to the process control of burnishing operations in production.

As is well known and widely described in the turbine engine art, components such as the blades and vanes in such complex machines operate at high mechanical and thermal cyclic loading conditions. In addition they are often subject to high cycle vibratory stresses during operation. Cracks initiating from low cycle and high cycle fatigue loading conditions, or from foreign object damage (FOD), may propagate in the presence of excessive tensile stress loading conditions. One way to improve the fatigue life of components is to induce compressive stress conditions at selected locations within the component.

There are known methods to induce compressive residual stresses within components during manufacturing. The use of shot peening during manufacturing is well known in the art. In shot peening, a stream of media is directed at the surface of the component at high velocity, causing plastic deformation and residual compressive stresses in the component. Laser Shock Peening (LSP) is another method that has been used successfully to induce residual compressive stresses in components. Laser shock peening typically uses multiple radiation pulses from a laser to produce shock waves on the surface of a component which induces residual compressive stresses. Another method of inducing compressive residual stresses within components is by precision deep peening with a mechanical indenter, for example as described in U.S. Pat. No. 5,771,729 issued to Bailey et al. and assigned to the assignee of the present invention.

Burnishing methods such as Deep Roller Burnishing (DRB) and Low Plasticity Burnishing (LPB) have been used in manufacturing for various purposes, including the inducement of residual compressive stresses in components. In such processes, a burnishing element such as a roller or ball is pressed against the surface of a component and moved along a selected path on the component. The pressing force used during burnishing is such that it induces plastic strain and residual compressive stresses within the component near the burnished region. Burnishing tools are typically hydraulically operated, using a pressurized fluid to force the burnishing element onto the surface of the component. Mechanically loaded tools are also used.

Although conceptually simple, burnishing processes need methods to control their results in a high volume production environment. There are several parameters, such as fluid pressure, volume flow, spring loads, surface conditions, lubrication efficiency, burnishing element wear, etc. that can influence the residual stresses obtained from burnishing. Currently burnishing process control relies primarily on freezing all parameters and tooling, and inferring that the end result of the burnishing process is adequately controlled. Although some of the machine control parameters such as pressures, speeds etc. can be can be monitored during manufacturing, these generally are not adequate to verify process control variations from other sources. Geometric measurements and visual assessments provide only limited evaluation of the burnished component. The beneficial residual stresses imparted to the interior region of the burnished component cannot be easily measured non-destructively. Accordingly, there is a need for a device and method to enable burnishing process control that simulates the entire process as applied to a component in production without the need for frequent, expensive, or destructive evaluations of the treated components.

BRIEF DESCRIPTION OF THE INVENTION

The above-mentioned need is met by the present invention, which according to one aspect provides an apparatus and method using burnishing process control coupons are described that can be used for process control of the burnishing process. These simulate the total burnishing process as applied to a part in a production environment and are similarly sensitive to process variations that may affect the final result on the components.

According to another aspect of the invention, the apparatus for process control of a burnishing process comprises a body, two ends, at least one process control coupon, and means for attaching the process control coupon to the body. At least one edge of the process control coupon is clamped along its entire length during burnishing. The process control coupons are made from commercially available and low cost materials such as spring steel. They can also be made from the same material as the components, such as titanium.

According to another aspect of the invention, In another embodiment, the apparatus has a coupon support which provides lateral support to the coupons during burnishing. Two process control coupons can be mounted in the apparatus and burnished simultaneously.

According to another aspect of the invention, a new method of process control for burnishing of components includes selecting at least one process control coupon, selecting an apparatus for holding them, attaching them to the apparatus, selecting a region on the surface of the process control coupon for burnishing. Using a burnishing process, a patch is then burnished on the selected region. After burnishing, at least one physical parameter at a selected location of the process control coupon is measured. These physical parameters may include deflections, cold work, residual stresses, plastic strains, X-Ray diffraction results, etc. in the coupons resulting from the burnishing operations. Based on previously established correlations with the burnishing results on components, the measurements on the process control coupons effect process control in production.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
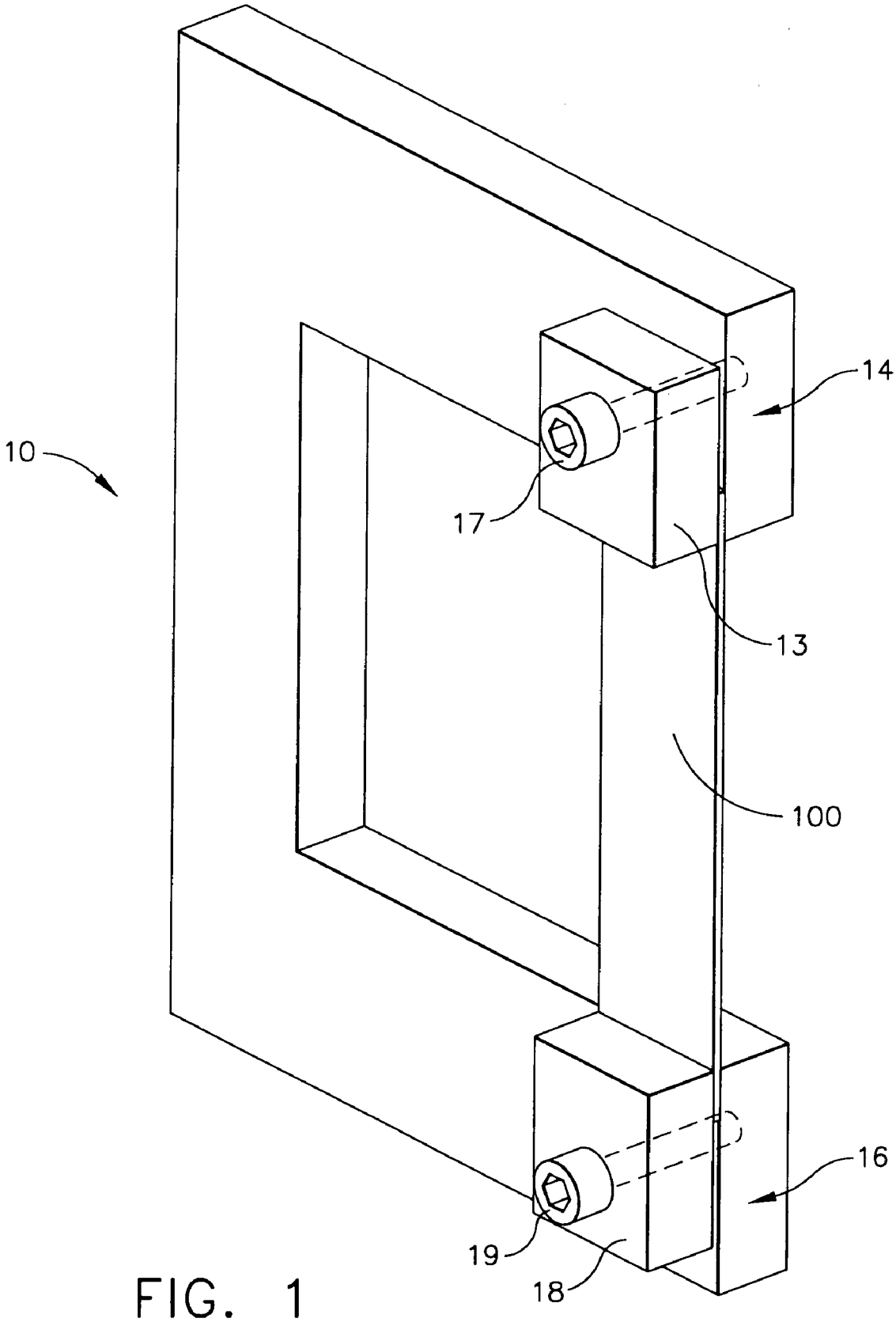
FIG. 1 shows an example of a burnishing process control apparatus with a process control coupon mounted in it.

Referring to the drawings wherein identical reference numerals denote the same elements throughout the various views, FIG. 1 depicts an example of an apparatus 10 for process control of a burnishing process such as a roller burnishing process or deep roller burnishing. The apparatus comprises a generally "C"-shaped body 12 having a first end 14 spaced apart from a second end 16. A burnishing process control coupon 100 is attached between the first end 14 and the second end 16. A conventional Almen strip may be used for the process control coupon 100.

In the embodiment shown in FIG. 1, one process control coupon 100 is attached using two clamping plates 13, and 18 and two fasteners 17 and 19. Other clamping devices, such as C-clamps, could be used in place of the fasteners 17 and 19, so long as the clamping plates 13 and 18 are securely held in place. The clamping plates 13 and 18 are used to mount the process control coupon 100 such that it is totally fixed along its entire top edge 101 and bottom edge 102 (see FIG. 3). Such mounting prevents the top edge 101 or the bottom edge 102 from deflecting during the burnishing operation. A backing plate 109 is placed next to the process control coupon 100 to prevent excessive bending that might produce unreliable test results. For example, the backing plate 109 may be about 7.62 mm (0.3 in.) to about 10.2 mm (0.4 in.) thick.

Figure 2:
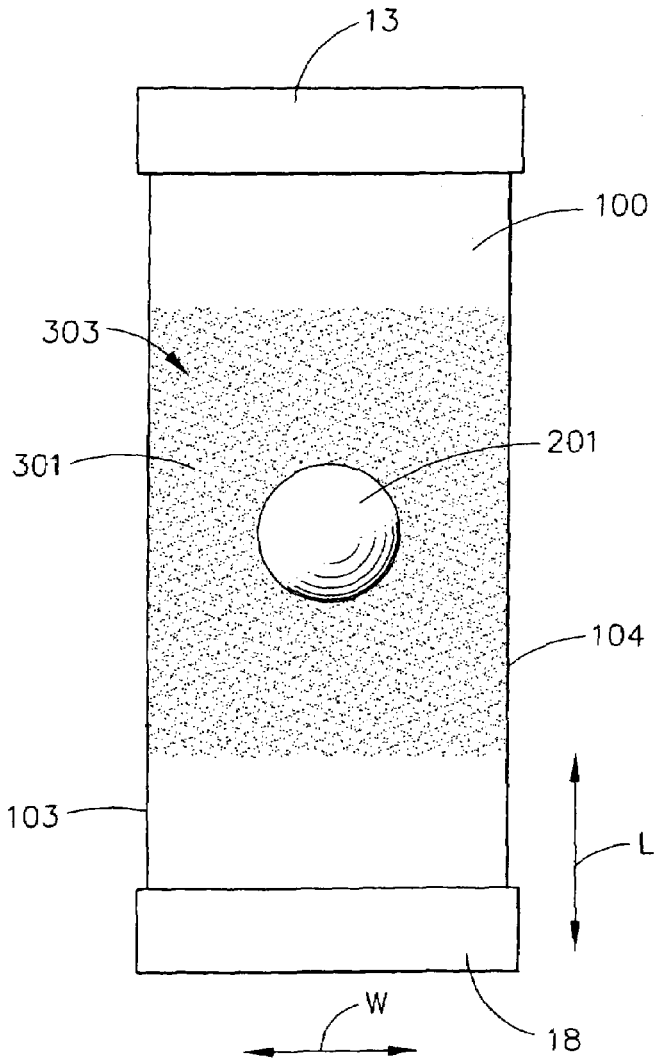
FIG. 2 shows a schematic front view of a burnishing process control coupon with a burnished patch thereon.
Figure 3:
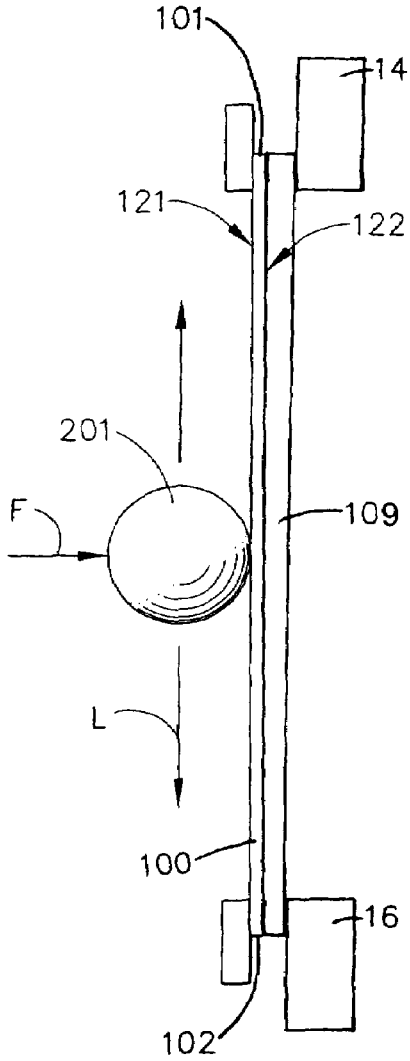
FIG. 3 is a side view of the burnishing process control coupon of FIG. 2.

FIGS. 2 and 3 show schematically a roller burnishing tool 201 contacting the burnishing surface 121 of a burnishing process control coupon 100. Many shapes of the burnishing tool 201 can be used in the burnishing operation, for example a spherical roller burnishing tool. A region 301 on the surface 121 of the burnishing process control coupon 100 is selected where burnishing operation is to be performed to create a burnished patch 303, as described in more detail below.

Figure 4:
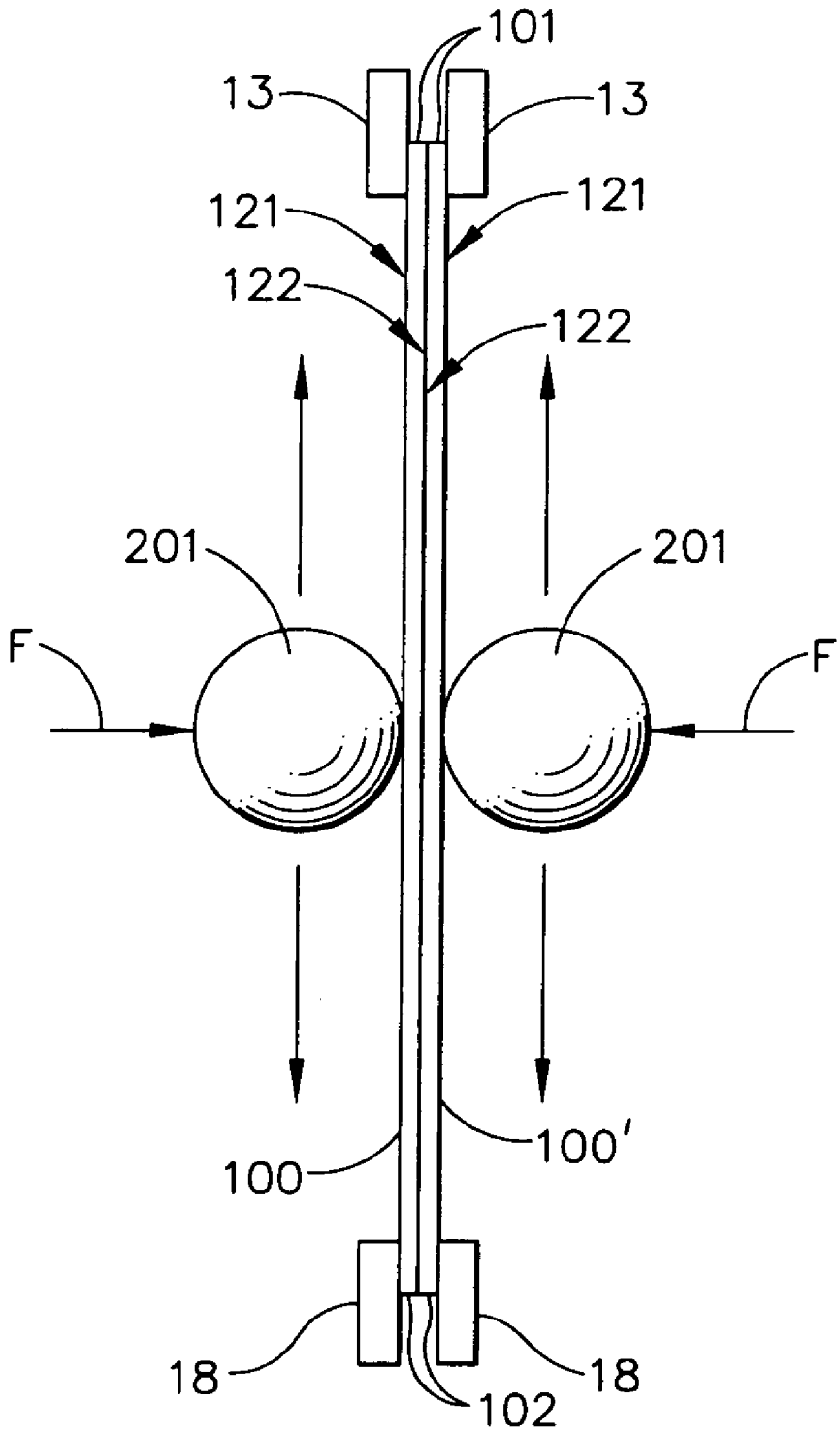
FIG. 4 shows a schematic side view of two burnishing process control coupons being burnished simultaneously.
Figure 5:
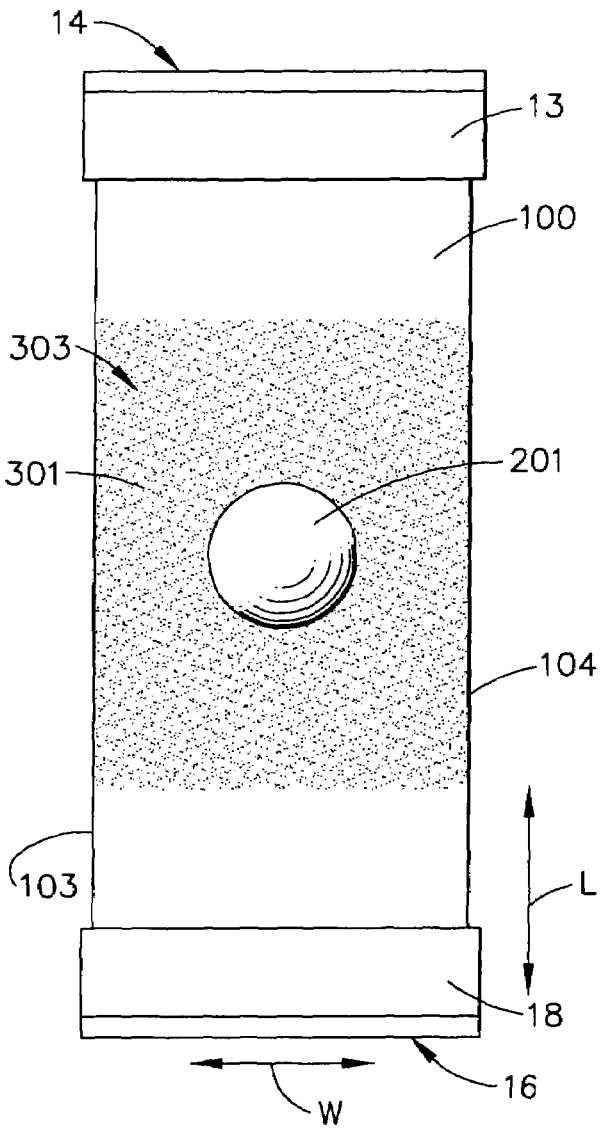
FIG. 5 is a schematic front view of two burnishing process control coupons mounted in an alternative embodiment of the burnishing process control apparatus.

In another embodiment of the present invention, schematically shown in FIG. 4, two burnishing process control coupons 100 are mounted within the apparatus 10 such that the lateral surfaces 122 of the coupons are adjacent to each other. The two burnishing process control coupons are attached at some of the edges 101, 102, 103 and 104 to the apparatus by suitable means, such as by clamping along edges 101 or 102 using clamps 13 and 18 and fasteners 17 and 19 as shown in the exemplary embodiment in FIG. 1. Other clamping devices, such as C-clamps, could be used in place of the fasteners 17 and 19, so long as the clamping plates 13 and 18 are securely held in place. A burnishing patch size and location on the burnishing surface 121 is selected for the two burnishing process control coupons. A typical burnishing patch size of 35 mm (1.4 in.) long and 17 mm (0.7 in.) wide is adequate for roller burnishing. Burnishing is performed simultaneously on the two burnishing process control coupons 100 by applying the burnishing forces F from opposing directions normal to the burnishing surface 121 of each of the coupons 100 as shown schematically in FIG. 3. Typical burnishing force of approximately 25 kg (55 lbs.) is used for Almen strip size A coupons made of spring steel. The force may be different if other coupons, such as Almen strip sizes "N" or "C" are used. Lower or higher application forces to result in reduced or enhanced depths of compression by the burnishing would be reasons to use "N" or "C" strips, respectively. The length-wise direction L of burnishing substantially parallel to the edges 103 and 104 shown in FIG. 3 is only exemplary. Other directions, such as for example, one substantially perpendicular to the edges 103 and 104, may be selected.

Figure 6:
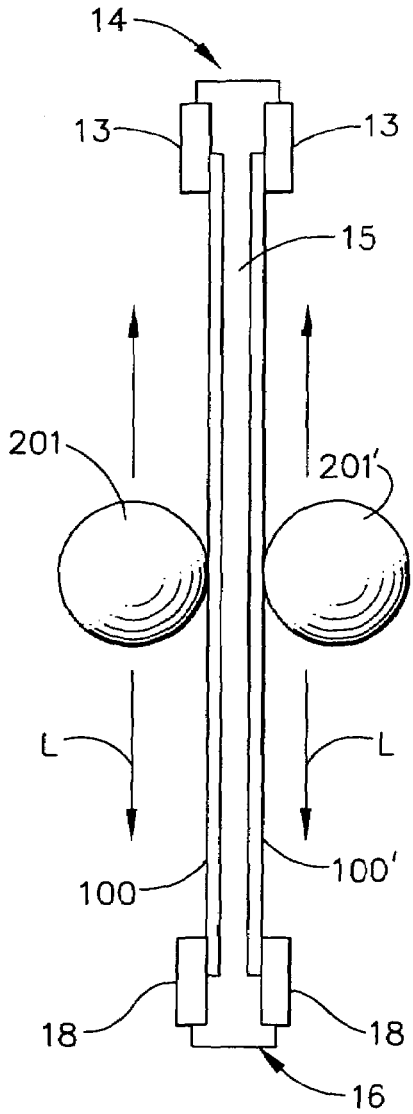
FIG. 6 is a side view of the burnishing process control coupons shown in FIG. 5.
Figure 7:
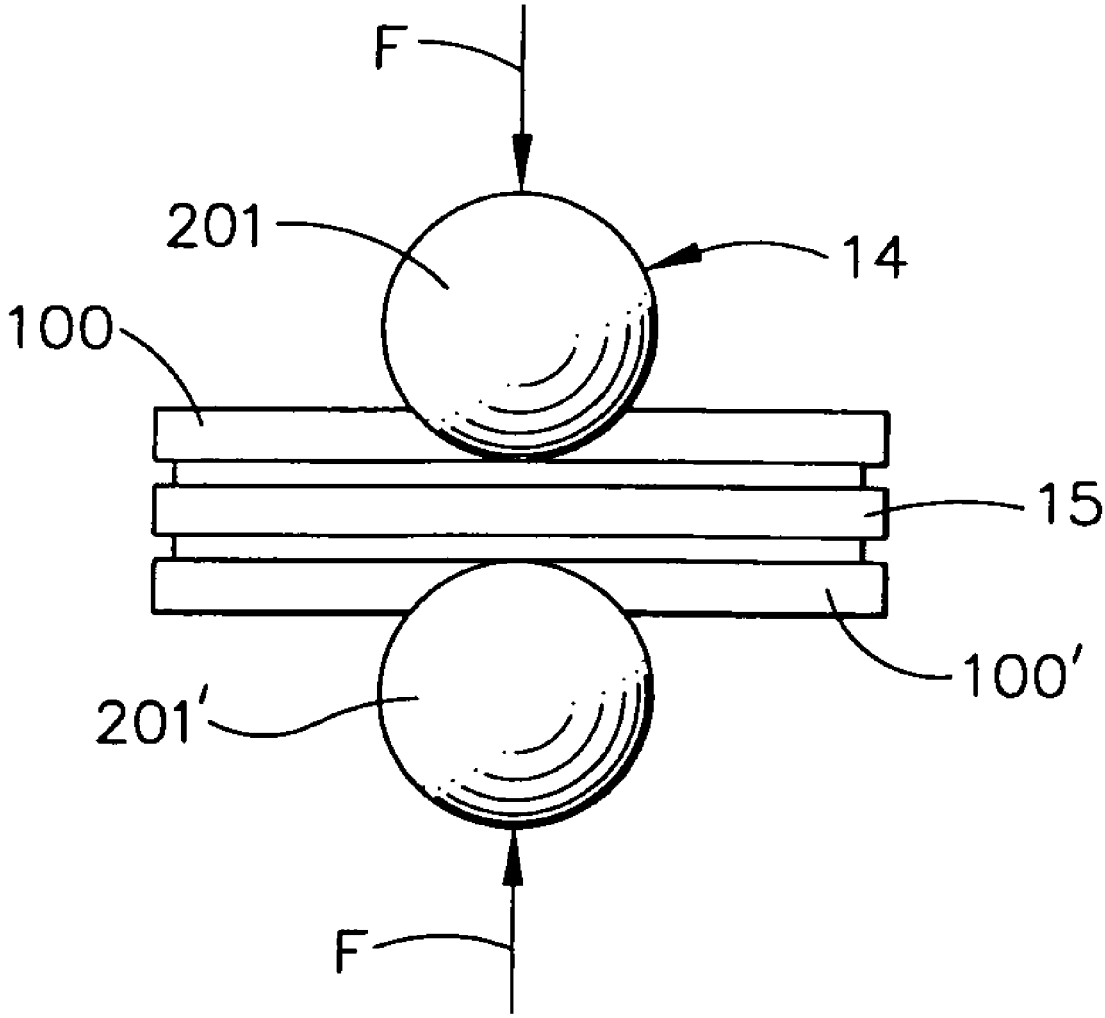
FIG. 7 is an end view of the burnishing process control coupons shown in FIG. 6.

In another embodiment of the present invention, shown in FIG. 6, the burnishing process control apparatus includes a coupon support 15 which provides lateral support to the burnishing process control coupons 100 during the burnishing operation. The coupons 100 are attached to the apparatus 10 by suitable clamping means, such as the illustrated clamping plates 13 and 18 and fasteners 17 and 19 described above to clamp some of the edges 101, 102, 103, and 104. In the exemplary embodiment shown in FIG. 6, the coupon support 15 extends between the first end 14 and the second end 16 of the apparatus 10. The coupon support 15 is sufficiently thick, e.g. approximately 4 mm (0.16 in.) such that it provides a rigid lateral support to the burnishing process control coupons 100 along the entire surface 122 opposite to the burnishing surfaces 121. The advantage of this embodiment is that because of the higher rigidity of the apparatus, higher burnishing forces F can be applied without causing undesirable deflections on the coupons 100 during burnishing. Another advantage of the embodiment shown in FIG. 4 is that the set up time is shorter due to the precise location of the coupons 100 within the apparatus 10 against the support 15. FIG. 4 shows the case where the coupons are clamped along two edges 101 and 102. Other clamping arrangements are also contemplated within the scope of the present invention. For example, three edges (101, 102, 103) may be clamped prior to burnishing. Or, all the edges of the burnishing process control coupons (101, 102, 103, 104) may be clamped prior to burnishing. Selections of the burnishing patch size and location, and selection of burnishing directions, are similar to those described above.

The apparatus described above is used for the process control of the burnishing process. As noted above, there are several variables that can affect the results of burnishing operations. Process variations in these variables can be difficult or impossible to monitor in production applications where burnishing is performed on hundreds of components. The method of process control described in this specification enables a cost effective and simple way of monitoring the burnishing process in a production environment.

The method comprises selecting at least one process control coupon 100, selecting an apparatus 10 for holding the process control coupon 100, attaching the coupon 100 to the apparatus 10, selecting a region on the surface of the process control coupon 100 for burnishing, burnishing a patch on the selected region and measuring at least one physical parameter of the process control coupon 100 after burnishing. These steps are further detailed below.

A process control coupon 100 is selected for burnishing using the same burnishing tool and process as used for the burnishing of components in production. This coupon 100 typically has a rectangular shape, approximately 7.62 cm (3 in.) long and 1.9 cm (0.75 in.) wide, with a substantially constant thickness of about 1.3 mm (0.050 in.) Other suitable shapes and sizes can also be used. For example, standard Almen strips, such as those used for measuring shot peen intensities described in SAE Standard J442, can be used. If desired, the material of the coupon 100 may be selected to be same as that of the components burnished, such as titanium blades used in aircraft engines. A process control apparatus 10, such as shown in the exemplary embodiments in FIG. 1 and FIG. 4 is then selected for holding the process control coupon 100.

The process control coupon is then mounted on the selected process control apparatus. As described above, multiple coupons 100 can be used within the apparatus 10.

For example, FIG. 6 shows two process control coupons 100 mounted adjacent to the two sides of the coupon support 15. The process control coupons 100 are mounted such that selected ones of the edges 101, 102, 103, 104 of the coupons 100 are clamped along their entire length to eliminate edge deflections during burnishing.

A region on the process control coupon 100 is selected for burnishing. In the exemplary embodiment shown in FIG. 2, a rectangular region 301 on one lateral face 121 of the process control coupon is selected for burnishing. In this example, the opposing face 122 is not selected for burnishing. Although a rectangular shape for the patch is the preferred, it is possible to select regions of other shapes for burnishing on either of the lateral faces 121,122. The selected region may encompass an entire lateral surface 121 of the process control coupon, although it is not always necessary to do so for effecting process control of the burnishing process. A burnished region smaller than the entire lateral surface is usually adequate.

A burnishing operation is then performed on the selected region 301 using burnishing techniques known in the art, such as roller burnishing, deep roller burnishing (DRB), or low plasticity burnishing (LPB). In such a process, a burnishing tool, such as a roller 201 is pressed against the surface 121 of the process control coupon 100 to create a burnishing force "F" while traversing a selected path in a selected direction. Such a burnishing operation causes plastic deformation in the coupon 100 and creates a burnished patch 303 on the surface of the process control coupon. The burnishing operation creates residual stresses within the process control coupon near the burnished patch. The selected burnished patch 303 may cover the entire surface 121 of burnishing process control coupon 100 that is outside of the clamping plates 13 and 18, or it may cover only a part of the surface 121 as shown in FIG. 2.

The burnishing operation is performed along selected paths on the selected region 301. FIG. 2 shows exemplary burnishing paths in the length-wise direction "L" created by a burnishing operation performed substantially parallel to the length-wise edges 103, 104 of the process control coupon 100. It is also possible to perform the burnishing operation in other directions (not shown in FIG. 2), such as in the width-wise direction W which is substantially perpendicular to the length-wise edges 103, 104. Although not shown in FIG. 2, any other combination of directions is possible for the path of burnishing and is within the scope of the present invention. It is known in the art that such burnishing process can cause a residual stress distribution within the burnishing process control coupon 100.

After the burnishing operation is completed, the clamping along the selected edges 101, 102, 103, 104 is released and the process control coupon 100 is removed from the apparatus 10. Post-burnishing measurements of selected physical parameters affected by the burnishing operation are then taken on the process control coupon. Examples of such parameters include deflections, cold work, X-ray diffraction, surface texture, etc.

One exemplary physical parameter that can be used for burnishing process control is the deflection of the process control coupon. As pointed out earlier, burnishing operation creates residual stresses within the process control coupon 100. When the clamping along the edges 101, 102, 103 and 104 is released, it allows certain deflections in the process control coupon 100. These deflections can be measured at selected points, such as for example, in the center of the burnishing patch 303 or the middle of an edge that was not clamped during burnishing. Other suitable points can be selected for measurements, depending on the size, shape and location of the burnishing patch 303 used.

In the context of burnishing process control, it is only necessary to determine that the physical parameter measured falls within certain established limits for the parameters. It is not necessary to establish the absolute values for these parameters. It is possible to use pre-calibrated gages to determine whether the specific physical parameter used (such as for example, deflections) fall within the pre-established limits. These limits for the physical parameters for the burnished process control coupons 100 are established based on known techniques to correlate with measured burnishing results on the components. Process control (or lack thereof) determination is made based on a quick measurement (in a production environment) of the selected physical parameter for the process control coupon, and pre-established correlations with the results for the burnished component.

The foregoing has described a method and related apparatus for process control of burnishing. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation, the invention being defined by the claims.

What is claimed is:

1. An apparatus for process control of a burnishing process comprising:

a body having a first end and a second end connected by an elongated process control coupon support;

two process control coupons having spaced-apart surfaces bounded by spaced-apart longitudinal edges and spaced-apart lateral edges, the process control coupons clamped to opposite sides of the process control coupon support such that the process control coupon support provides lateral support to the two process control coupons during burnishing; and means for attaching said process control coupons to at least one of said first end and said second end, wherein at least one of said edges of each of said process control coupons is restrained along the entire length thereof during burnishing.

2. An apparatus according to claim 1 wherein the means for attaching said process control coupons comprises at least one clamping plate for engaging said process control coupons and at least one clamping device for securing said clamping plate.

3. An apparatus according to claim 1 wherein said process control coupon coupons are attached to said first end and said second end.

4. An apparatus according to claim 1 wherein said process control coupons are clamped along three edges thereof.

5. An apparatus according to claim 1 said process control coupons are clamped along all of said edges.

6. An apparatus according to claim 1 wherein said process control coupons comprise titanium.

7. An apparatus according to claim 1 wherein said process control coupons comprise spring steel.

8. A method of process control for burnishing of components comprising:

providing at least one process control coupon;

providing an apparatus for holding said least one process control coupon;

attaching said process control coupon to said apparatus;

selecting a region on the surface of said least one process control coupon for burnishing;

burnishing a patch on the selected region using a burnishing process with selected process parameters;

measuring at least one physical parameter of said process control coupon affected by said burnishing process at a selected location of the at least one process control coupon after burnishing; and comparing the at least one measured physical parameter to pre-established limits representing predetermined desired burnishing results on a workpiece, so as to determine if the selected process parameters will generate the predetermined desired burnishing results.

9. A method according to claim 8 further comprising providing two process control coupons for burnishing simultaneously.

10. A method according to claim 8 wherein the region on the surface process control coupon selected for burnishing is smaller than the entire surface of the process control coupon.

11. A method according to claim 8 wherein burnishing is performed in the lengthwise direction of said process control coupon.

12. A method according to claim 8 wherein burnishing is performed in the widthwise direction of said process control coupon.

13. A method according to claim 9 wherein burnishing is performed simultaneously in the lengthwise direction of the process control coupons.

14. A method according to claim 9 wherein burnishing is performed simultaneously in the widthwise direction of the process control coupons.

15. A method according to claim 8 wherein the measured physical parameter is a deflection at a point on the coupon.

16. A method according to claim 8 wherein the measured physical parameter is the surface texture of the burnished area on the process control coupon.

17. A method according to claim 8 wherein the measured physical parameter is the amount of cold work in the burnished area on the process control coupon.

* * * * *

UNITED STATES PATENT AND TRADEMARK OFFICE

CERTIFICATE OF CORRECTION

PATENT NO. : 7,185,521 B2
APPLICATION NO. : 11/128565
DATED : March 6, 2007
INVENTOR(S) : Dale Robert Lombardo It is certified that error appears in the above-identified patent and that said Letters Patent is hereby corrected as shown below:

Column 6, line 48-49, enter a comma after the word "coupons".

Column 6, line 52, delete the word "coupon".

Signed and Sealed this

First Day of May, 2007

JON W. DUDAS
*Director of the United States Patent and Trademark Office*

US007185521C1

(12) EX PARTE REEXAMINATION CERTIFICATE (6447th)

United States Patent
Lombardo et al.

(10) Number: US 7,185,521 C1
(45) Certificate Issued: Sep. 16, 2008

(54) METHOD AND APPARATUS FOR PROCESS CONTROL OF BURNISHING

(75) Inventors: Dale Robert Lombardo, Blue Ash, OH (US); Alberto Luna, Cincinnati, OH (US); Michael J. Brunck, Cincinnati, OH (US)

(73) Assignee: General Electric Company, Schenectady, NY (US)

Reexamination Request:
No. 90/008,761, Jul. 18, 2007

Reexamination Certificate for:

| | |
|---|---|
| Patent No.: | **7,185,521** |
| Issued: | **Mar. 6, 2007** |
| Appl. No.: | **11/128,565** |
| Filed: | **May 13, 2005** |

Certificate of Correction issued May 1, 2007.

(51) Int. Cl.
*B21D 17/04* (2006.01)
*B21B 37/00* (2006.01)

(52) U.S. Cl. ..... 72/75; 29/90.01; 72/293; 72/7.1; 72/7.4

(58) Field of Classification Search ..... None
See application file for complete search history.

(56) References Cited

U.S. PATENT DOCUMENTS 6,483,578 B1 11/2002 Clauer et al.
6,622,570 B1 * 9/2003 Prevey, III ..... 73/826
6,959,572 B2 11/2005 Lawrence et al.
2005/0171703 A1 * 8/2005 Goldfine et al. ..... 702/30

OTHER PUBLICATIONS

Prevey et al., "Improved HCF Performance and FOD Tolerance of Surface Treated Ti–6–2–4–6 Compressor Blades," Proceedings of the 9th National Turbine Engine High Cycle, Fatigue Conference, Mar. 16–19, 2004, Pinehurst, North Carolina.

* cited by examiner

*Primary Examiner*—Peter C. English

(57) ABSTRACT

An apparatus for process control of a burnishing process comprising a body having a first end and a second end, at least one process control coupon, and structure for attaching the process control coupon to the body. At least one edge of the process control coupon is clamped along the entire length thereof during burnishing. A method of process control for burnishing of components comprising selecting at least one process control coupon, selecting an apparatus for holding the process control coupon(s), attaching the process control coupon(s) to the apparatus, selecting a region on the surface of the process control coupon(s) for burnishing, burnishing a patch on the selected region using a burnishing process, and, measuring at least one physical parameter at a selected location of the process control coupon(s) after burnishing.

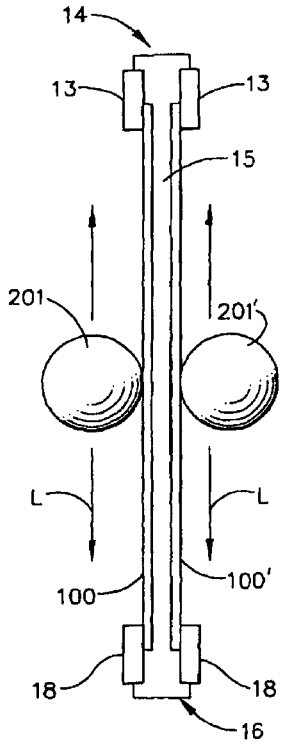

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–7 is confirmed.

Claims 8–12 and 15–17 are determined to be patentable as amended.

Claims 13 and 14, dependent on an amended claim, are determined to be patentable.

8. A method of process control for burnishing of components comprising:

providing [at least one process control coupon] *two process control coupons having spaced-apart surfaces bounded by spaced-apart longitudinal edges and spaced-apart lateral edges*;

providing an apparatus for holding said [least one] process control [coupon;] *coupons, the apparatus comprising*:

*a body having a first end and a second end connected by an elongated process control coupon support; and means for attaching said process control coupons to at least one of said first end and said second end;*

[attaching said process control coupon to said apparatus] *clamping the process control coupons to opposite sides of the process control coupon support such that the process control coupon support provides lateral support to the two process control coupons during burnishing, wherein at least one of said edges of each of said process control coupons is restrained along the entire length thereof during burnishing*;

selecting a region on the surface of [said] *at* least one *of said* process control [coupon] *coupons* for burnishing;

burnishing a patch on the selected region using a burnishing process with selected process parameters;

measuring at least one physical parameter of said *at least one* process control coupon affected by said burnishing process at a selected location of the at least one process control coupon after burnishing; and comparing the at least one measured physical parameter to pre-established limits representing predetermined desired burnishing results on a workpiece, so as to determine if the selected process parameters will generate the predetermined desired burnishing results.

9. A method according to claim 8 further comprising [providing] *burnishing the* two process control coupons [for burnishing] simultaneously.

10. A method according to claim 8 wherein the region on the surface *of the at least one* process control coupon selected for burnishing is smaller than the entire surface of the *at least one* process control coupon.

11. A method according to claim 8 wherein burnishing is performed in the lengthwise direction of said *at least one* process control coupon.

12. A method according to claim 8 wherein burnishing is performed in the widthwise direction of said *at least one* process control coupon.

15. A method according to claim 8 wherein the measured physical parameter is a deflection at a point on the *at least one process control* coupon.

16. A method according to claim 8 wherein the measured physical parameter is the surface texture of the burnished area on the *at least one* process control coupon.

17. A method according to claim 8 wherein the measured physical parameter is the amount of cold work in the burnished area on the *at least one* process control coupon.

* * * * *